US009117366B1

(12) United States Patent
Seah et al.

(10) Patent No.: US 9,117,366 B1
(45) Date of Patent: Aug. 25, 2015

(54) COMMUNICATION METHODS EMPLOYED BY PARTICIPANTS IN A TRAJECTORY MANAGEMENT OPERATIONS

(71) Applicants: Kirschen A. Seah, Cedar Rapids, IA (US); Alan E. Siniff, Marion, IA (US)

(72) Inventors: Kirschen A. Seah, Cedar Rapids, IA (US); Alan E. Siniff, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 36 days.

(21) Appl. No.: 13/628,101

(22) Filed: Sep. 27, 2012

(51) Int. Cl.
*G08G 5/00* (2006.01)

(52) U.S. Cl.
CPC ..... *G08G 5/0004* (2013.01); *G08G 5/003* (2013.01); *G08G 5/0039* (2013.01); *G08G 5/006* (2013.01); *G08G 5/0043* (2013.01)

(58) Field of Classification Search
CPC ... G08G 5/006; G08G 5/0039; G08G 5/0043; G08G 5/0004; G08G 5/003
USPC ..... 701/120, 122
See application file for complete search history.

(56) References Cited

U.S. PATENT DOCUMENTS 6,789,011 B2 * 9/2004 Baiada et al. ..... 701/120
7,877,197 B2 * 1/2011 Lewis et al. ..... 701/120
8,606,491 B2 * 12/2013 Subbu et al. ..... 701/120
2012/0191331 A1 * 7/2012 Torres et al. ..... 701/120
2012/0245834 A1 * 9/2012 Klooster et al. ..... 701/120
2013/0085661 A1 * 4/2013 Chan et al. ..... 701/122

OTHER PUBLICATIONS

Klooster, J.; Torres, S.; Earman, D.; Castillo-Effen, M.; Subbu, R.; Kammer, L.; Chan, D.; Tomlinson, T., "Trajectory synchronization and negotiation in Trajectory Based Operations," Digital Avionics Systems Conference (DASC), 2010 IEEE/AIAA 29th , vol., No., pp. 1.A.3-1,1.A.3-11, Oct. 3-7, 2010.*

Joint Planning and Development Office, "Concept of Operations for the Next Generation Air Transportation System", Sep. 30, 2010, version 3.2.

* cited by examiner

*Primary Examiner* — Helal A Algahaim
*Assistant Examiner* — Donald J Wallace
(74) *Attorney, Agent, or Firm* — Angel N. Gerdzhikov; Donna P. Suchy; Daniel M. Barbieri

(57) ABSTRACT

A plurality of present novel and non-trivial communication methods employed between the participants of a trajectory management operation is disclosed. A trajectory coordinator ("TC") generator may be configured to send data representative of a polling request to one or more of the participants, receive data responsive to the sending of the polling request, generate data representative of one or more proposed trajectories of the TC, and send data representative of each TC-proposed trajectory to an air navigation service provider ("ANSP") and/or a dispatch center ("DC"). When presented to a controller of the ANSP or a dispatcher of the DC, one or more of the trajectories may be sent to the aircraft system. In response, each ANSP-selected trajectory and each DC-selected trajectory may be presented to the pilot whom selects and approves one of the selected trajectories. In response, the pilot-selected trajectory may be sent to the ANSP and DC.

19 Claims, 8 Drawing Sheets

COMMUNICATION METHODS EMPLOYED BY PARTICIPANTS IN A TRAJECTORY MANAGEMENT OPERATIONS

BACKGROUND OF THE INVENTION

1. Field of the Invention

This invention pertains generally to the field of aviation which manages or generates flight path data or trajectory data for an aircraft in flight.

2. Description of the Related Art

In the United States ("U.S."), preparations have begun to implement the Next Generation Air Transport System ("NextGen"), a system designed to reduce the stress currently experienced in the U.S and address the expected growth in aircraft operations forecasted through 2025. A Concept of Operations ("ConOps") developed for NextGen has identified many NextGen capabilities which detail the overall effect desired through the implementations of specific standards, processes, and conditions. One of these identified capabilities is an air traffic management ("ATM") capability known as Efficient Trajectory Management, which provides the ability to assign trajectories that minimize the frequency and complexity of aircraft conflicts through the negotiation and adjustment of individual aircraft trajectories and/or sequences when required by resource constraints.

The ConOps has identified many stakeholders (or users) including an air navigation service provider ("ANSP") and flight operators. The ANSP has been identified as providing ATM and air traffic control services for flight operators for the purpose of providing safe and efficient flight operations. ATM responsibilities include communications, navigation, and surveillance ("CNS"). Flight operators have been identified as planning and operating a flight within the National Airspace System ("NAS"), including flight crews, flight operations centers, and operators conducting private, business, scheduled air transport, government, and military flight operations.

One of the goals and objectives of NextGen is a concept of trajectory-based operations ("TBO"). The basis for TBO is knowing each aircraft's expected flight profile and time information beforehand. The specificity of four-dimensional trajectories ("4DT") is supposed to match the mode of operations and the requirements of the airspace in which the aircraft operates. A major benefit of 4DT is that it enables ANSPs and operators to assess the effects of proposed trajectories and resource allocation plans, allowing ANSPs and operators to understand the implications of demand and identify where constraints need further mitigation.

The flight management system ("FMS") is capable of storing flight path information as well as 4DTs; however, the information available to the FMS and other aircraft systems may be limited. As such, the FMS and other aircraft systems may not have full knowledge of information that is available to the operator if the operator desires to optimize the flight trajectory of not only one aircraft in flight but also a plurality of other aircraft in flight which the operator may operate.

One way of optimizing the flight trajectory has been disclosed by Borghese et al in U.S. Pat. No. 8,600,675 entitled "System and Method for Generating Trajectory Data for an Aircraft in Flight," a reference which is incorporated by reference in its entirety. In the reference, two-way communications are established between three parties: a dispatch center ("DC") of flight operators, an aircraft system of an aircraft in flight (and aircraft systems of other aircraft), and the ANSP. From data provided by the aircraft system(s) and the ANSP, the trajectory data generator of the DC as disclosed therein has been configured to determine an optimized flight trajectory employing a trajectory optimization function, generate DC trajectory data representative of the optimized flight trajectory, and send the generated DC trajectory data to the other parties.

BRIEF SUMMARY OF THE INVENTION

A plurality of present novel and non-trivial communication methods for use during trajectory management operations of aircraft in flight is disclosed herein. As disclosed herein, two-way communications are established between three participants: the aircraft system of an aircraft in flight, the ANSP and the DC. In addition, a trajectory coordinator ("TC") may be included to act as a coordinator and to initiate negotiations automatically and independently of any participant whom initiates negotiations by sending out proposals of trajectory data.

In one embodiment, a first communication method employed between the participants of a trajectory management operation is disclosed, where a TC generator may be configured to perform this method. When properly configured, the TC generator may send of data representative of a polling request, receive responsive data, generate data representative of one or more proposed trajectories, and send such data to the ANSP, the DC, or both.

In another embodiment, a second communication method employed between the participants of a trajectory management operation is disclosed, where a processor or processing unit of an aircraft system may be configured to perform this method. When properly configured, the processor may receive of data representative of a polling request, send data responsive to the polling request, receive data representative of one or more ANSP-selected trajectories and/or one or more DC-selected trajectories, receive data representative of a pilot-selected trajectory, and send such data to the ANSP and the DC.

In another embodiment, a third communication method employed between the participants of a trajectory management operation is disclosed, where a processor or processing unit of the ANSP and/or the DC may be configured to perform this method. When properly configured, the processor may receive of data representative of a polling request, send of data responsive to the polling request, receive of data representative of one or more TC-proposed trajectories, receive data representative of one or more ANSP-selected trajectories and/or one or more DC-selected trajectories, send data representative of each selected trajectory to the aircraft system, and receive data representative of a pilot-selected trajectory from the aircraft system.

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments of the invention.

Figure 1:
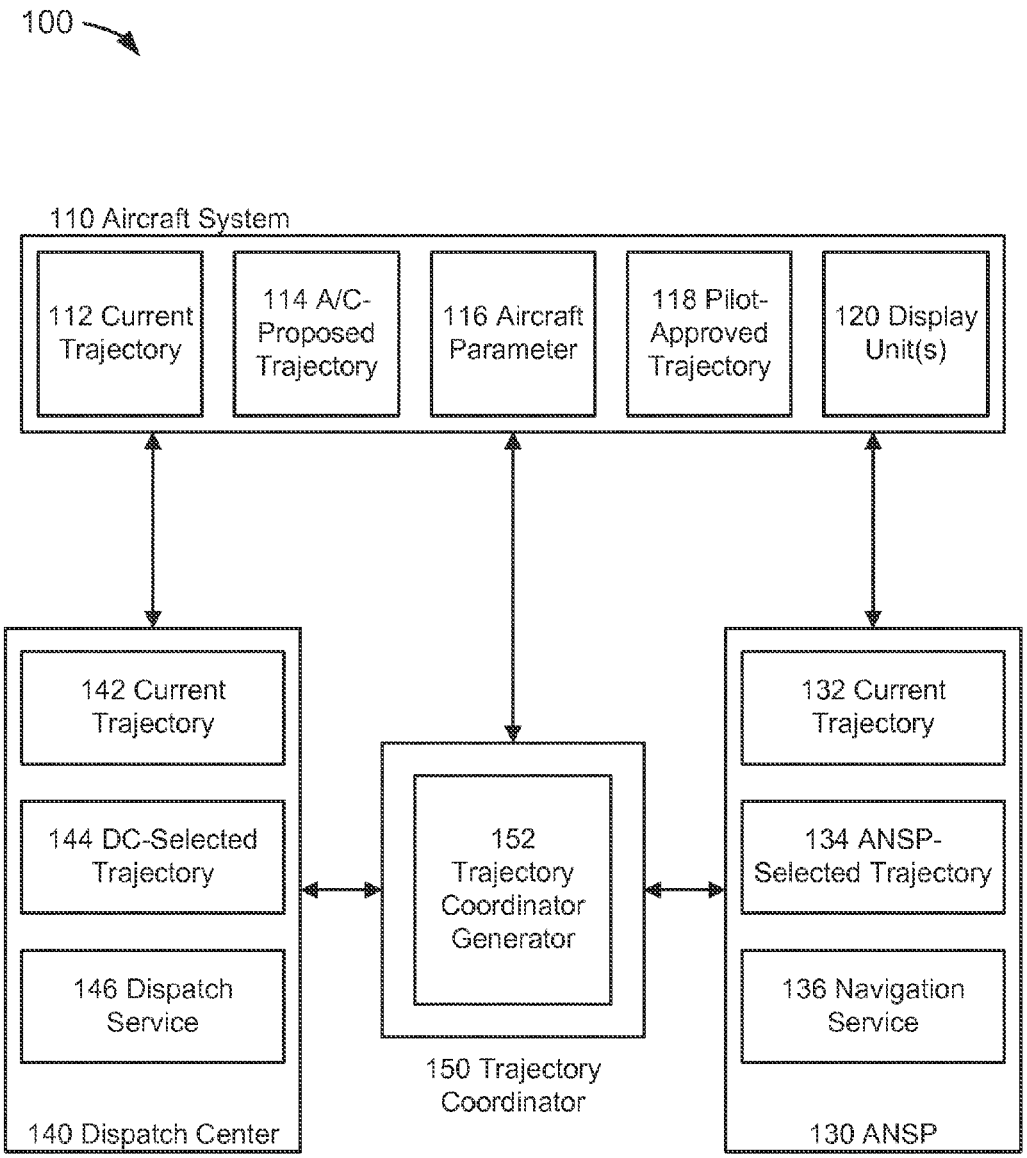
FIG. 1 depicts a block diagram of a trajectory management operation communication system.

FIG. 1 depicts a block diagram of a trajectory management operation communication system 100 suitable for implementation of the techniques described herein. The communication system 100 of an embodiment of FIG. 1 includes an aircraft system 110, an air navigation service provider ("ANSP") 130, a dispatch center ("DC") 140, and a trajectory coordinator ("TC") 150.

In an embodiment of FIG. 1, the aircraft system 110 could be comprised of a system or systems installed in the aircraft that could provide source data to the TC 150 via a datalink system or other system in which data may be communicated to users external to the aircraft. As embodied herein, the aircraft system 110 could also be comprised of the system or systems installed in multiple aircraft, each of which could provide source data to the TC 150. The source data could be comprised of current trajectory data 112, proposed trajectory data 114, aircraft parameter data 116, and/or pilot-accepted trajectory data 118. In addition, the aircraft system 110 could include display unit(s) 120 on which symbology representative of current trajectory data 112 and/or proposed trajectory data 114 could be presented to a pilot.

It should be noted that data, as embodied herein, could be comprised of any analog or digital signal, either discrete or continuous, which could contain information. As embodied herein, signals are synonymous with data. Aircraft could mean any manned or unmanned vehicle which is able to fly through the air, atmosphere, and/or space including, but not limited to, lighter than air vehicles and heavier than air vehicles, wherein the latter may include fixed-wing and rotary-wing vehicles. Additionally, aircraft could be watercraft capable of operating on or beneath water. Also, although not shown in FIG. 1, the aircraft system 110 could be located at a location from where unmanned vehicle(s) are piloted.

In an embodiment of FIG. 1, current trajectory data 112 may be comprised of data representative of a trajectory that has been assigned to the aircraft which may be defined as an assigned clearance to the aircraft or the expected flight path on which the aircraft has been cleared by an aviation-governing authority. The current trajectory could be comprised of a series of waypoints, altitude assignments, and/or time assignments. Current trajectory data 112 could be comprised of three-dimensional data representative of latitude, longitude, and altitude data; alternatively, current trajectory data 112 could include a fourth dimension of time. A common aircraft system for storing and/or maintaining current trajectory data 112 could be a flight management system ("FMS") (which includes a navigation database), a system known to those skilled in the art.

As embodied in FIG. 1, the proposed trajectory data 114 could be comprised of the same data representative of one or more trajectories selected by the ANSP 130 and/or the DC 140. As embodied herein, the proposed trajectory data 114 could be received by aircraft system(s) 110 for subsequent application to the trajectory generating function after being sent by the ANSP 130 and/or the DC 140.

In an embodiment of FIG. 1, aircraft parameter data 116 may be comprised of data representative of one or more aircraft parameters from one or more aircraft that may be applied in one or more trajectory generating functions of the TC 150 to determine one or more flight trajectories and generate proposed-trajectory data as discussed in detail below. The application of the aircraft parameter(s) may determine proposed trajectories that represent real-time predictable and achievable aircraft performance that may affect the maneuverability and/or responsiveness of the aircraft when operating within trajectory management operations. The advantages and benefits of the embodiments disclosed herein exploit the ability of the TC 150 to receive a plurality of aircraft parameters from one or more aircraft, apply them to a trajectory generating function(s) defined and contained in an algorithm, and determine a flight trajectory unique to actual conditions of flight operations as measured by the values of the aircraft parameters.

To provide a simple example of how aircraft parameters 116 may be used in the embodiments herein, suppose a trajectory generating function is a trajectory optimization function that includes meteorological or environmental parameters; those skilled in the art are aware that meteorological or environmental conditions affect aircraft performance and/or maneuverability. Meteorological or environmental parameters could include, but are not limited to, data representative of air density and winds aloft, where air density may be determined by such parameters as altitude, temperature, barometric pressure, and dew point, and winds aloft may be determined by such parameters as wind direction and wind speed. Here, data representative of these parameters may be provided as aircraft parameters 116 from one or more aircraft to the TC 150 for subsequent application of the trajectory optimization function. After the application of the aircraft parameters 116, the trajectory optimization function may determine an optimized flight trajectory unique to actual conditions of flight operations.

Other examples of aircraft parameters 116 are provided to illustrate the ability with which a manufacturer or end user may provide aircraft parameters 116 for use in the trajectory generating function as embodied herein. In one example, the trajectory generating function could include weight and balance parameters; if so, aircraft parameters 116 could include data representative of aircraft empty weight, center of gravity ("CG"), weight of fuel, and/or weight of cargo. In another example, the trajectory generating function could include aircraft configuration and system parameters; if so, aircraft parameters 116 could include data representative of the configuration(s) and/or operability of the aircraft flaps/slats, speed brake position, and/or the landing gear, each of which could affect the speed and/or expected times at which the aircraft will operate within trajectory management operations.

In another example, the trajectory generating function could include engine performance parameter(s); if so, aircraft parameters 116 could include data representative of engine performance or status or available thrust. In another example, the trajectory generating function could include traffic information of other aircraft; if so, aircraft parameters 116 could include data representative of horizontal position, pressure altitude, vertical rate, horizontal velocity, horizontal position accuracy, horizontal velocity accuracy, and/or aircraft identification of the other aircraft. In another example, the trajectory generating function could include parameters related to the quality of data provided by one or more of the data sources; if so, aircraft parameters 116 could include data representative of accuracy, resolution, integrity, uncertainty, and/or validity. The preceding examples are intended to provide exemplary aircraft parameters 116 that may be used in the communication system 100, and are not intended to provide a limitation to the embodiments discussed herein in any way, shape, or form.

In an embodiment of FIG. 1, the pilot-accepted trajectory data 118 could be comprised of data representative of a trajectory accepted by a pilot through the aircraft system 110, where the accepted trajectory could be indicative of an ANSP-selected trajectory or a DC-selected trajectory accepted by the pilot.

As embodied in FIG. 1, the display unit(s) 120 could be comprised of any unit on which visual indication(s) may be presented to the pilot. The display unit 120 could be comprised of any unit having a display surface on which information may be presented to the pilot. The display unit 120 could be part of an Electronic Flight Information System and could be comprised of, but is not limited to, a Primary Flight Display, Navigation Display, Head-Up Display, Head-Down Display, Multi-Purpose Control Display Unit, Engine Indicating and Crew Alerting System, Electronic Centralized Aircraft Monitor, Multi-Function Display, Side Displays, and/or Data Link Control Display Unit. As embodied herein, the display unit 120 may include a vision system (not shown) which generates an image data set which represents the image displayed on a display unit. Vision systems include, but are not limited to, a synthetic vision system, an enhanced vision system, and/or a combined SVS-EVS.

Figure 2A:
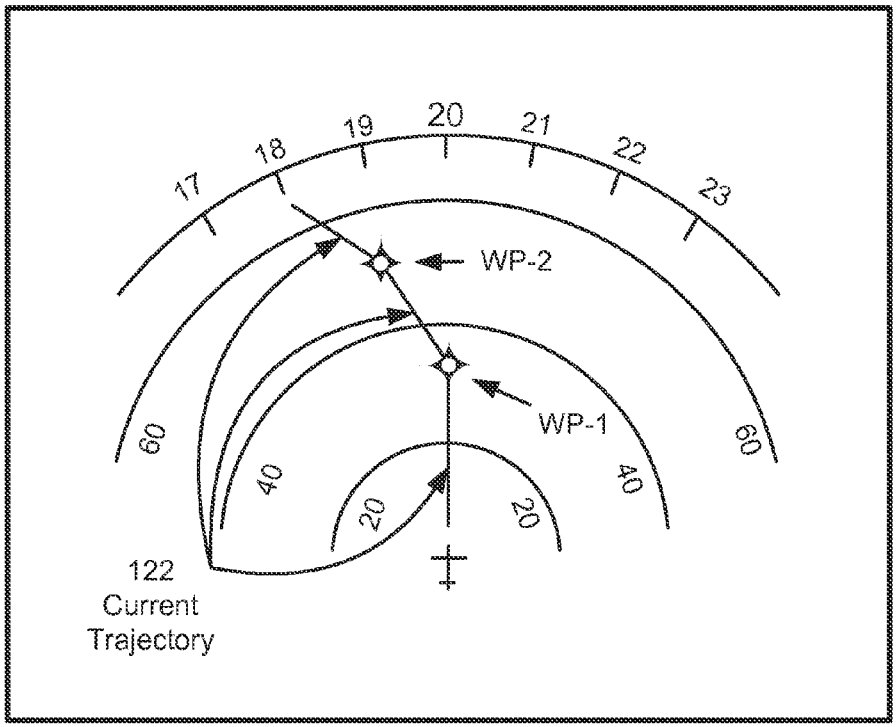
FIGS. 2A and 2B provide exemplary depictions of a display unit configured to present trajectory information to the pilot or flight crew.
Figure 2B:
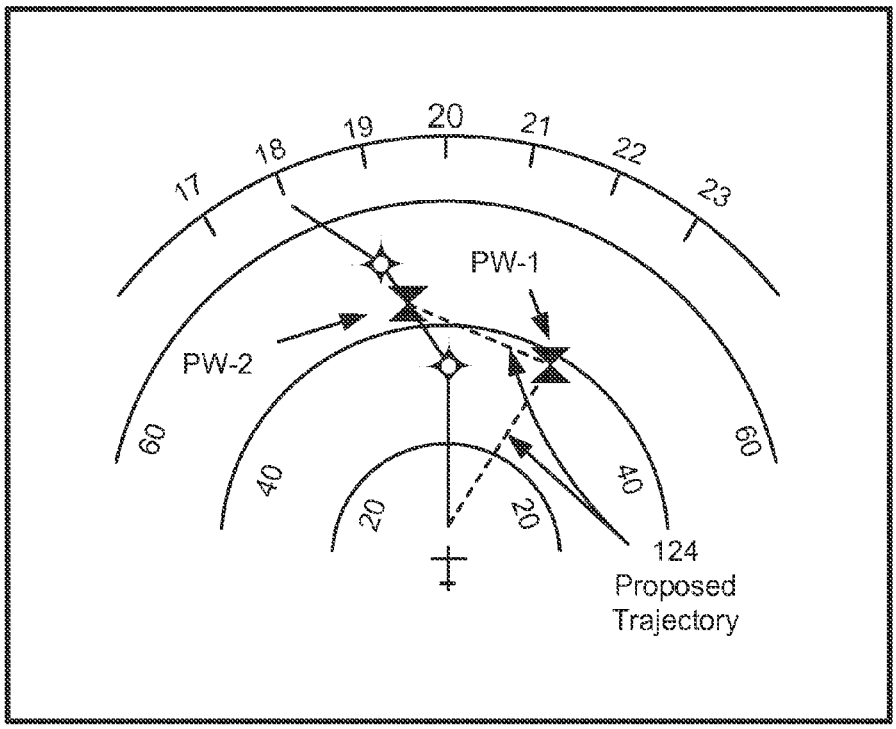

The advantages and benefits of the embodiments discussed herein may be illustrated by showing examples of how a request to change to the current trajectory of a flight path defined by waypoints may be presented on the display surface of the display unit 120. FIGS. 2A and 2B provide exemplary depictions of the display unit 120 for presenting trajectory information to the pilot or flight crew. FIG. 2A provides an exemplary depiction of how the current trajectory 122 represented by current trajectory data 112 of a flight path defined by waypoints WP-1 And WP-2 against range symbology may be presented on the display surface of the display unit 120; the presentation of additional trajectory symbology such as altitude and/or time could also be presented but has been made minimal for the sake of presentation and is not indicative of the plurality of indications or information with which it may be configured.

FIG. 2B provides an exemplary depiction of how a proposed trajectory 124 represented by proposed trajectory data 114 and defined by proposed waypoints PW-1 and PW-2 may be presented on the display surface of the display unit 120. As will be discussed in detail below, the proposed trajectory could be representative of a trajectory selected by the ANSP 130 and/or a trajectory selected by the DC 140.

Returning to FIG. 1, the ANSP 130 could be comprised of one or more providers of air navigation services that could provide source data to the TC 150. Such source data could be comprised of current trajectory data 132, ANSP-selected trajectory data 134, and/or air navigation services data 136. As embodied herein, the ANSP 130 could include an aviation-governing authority. In the United States, the ANSP 130 could include the Federal Aviation Administration.

In an embodiment of FIG. 1, the current trajectory data 132 may be comprised of data representative of the current trajectory that has been assigned to the aircraft. As embodied herein, the current trajectory represented in the current trajectory data 132 is the same current trajectory represented in the current trajectory data 112.

In an embodiment of FIG. 1, the ANSP-selected trajectory data 134 could be comprised of data representative of a proposed trajectory received from the TC 150, where the proposed trajectory could be indicative of a proposed change or modification to the current trajectory data 132. The ANSP 130 may request a proposed change and/or submit an ANSP-proposed trajectory automatically.

For an automatic initiation, the ANSP 130 could use a planned schedule based upon time and/or the position of the aircraft along the current trajectory. Also, the initiation could be based upon an unplanned occurrence such as changes to the one or more of the following non-exhaustive list of air navigation services that may be managed by the ANSP 130 and are known to those skilled in the art: trajectory management, flight and state management, separation management, weather information management, aeronautical information management, surveillance information management, flow contingency management, short-term capacity management, and long-term capacity management.

A proposed trajectory could be initiated manually by a controller through a manual input system, where such manual input system could be comprised of any source that provides or enables a controller to enter proposed trajectory information through a controller input device. The manual input system may include, but is not limited to, a tactile device (e.g., keyboard, control display unit, cursor control device, touch screen device, etc. . . . ) and/or a speech recognition system.

In an embodiment of FIG. 1, navigation service data 136 could be comprised of data corresponding to the preceding non-exhaustive list of air navigation services. Navigation service data 136 corresponding to trajectory management could be data corresponding to the means through which four-dimensional trajectories of multiple aircraft are generated, assessed, and modified for use in trajectory-based operations by the ANSP 130. Navigation service data 136 corresponding to flight and state data management could be data corresponding to the means through which an airspace system maintains and distributes all flight information, including aircraft characteristics and capabilities, flight plans and trajectories, flight status, and clearance delivery status. Navigation service data 136 corresponding to separation management data could be data corresponding to variations of flight trajectories of aircraft to resolve projected conflicts between aircraft.

Navigation service data 136 corresponding to weather information management could be data corresponding to the means for processing raw weather information and transforming it into an integrated, comprehensive, and authoritative source for all consumers and service providers including the DC 140. Navigation service data 136 corresponding to aeronautical information management could be data corresponding to the means to ensure that all stakeholders including the DC 140 have access to critical information about system resources, procedures, constraints, and other factors impacting the use of the airspace system. Navigation service data 136 corresponding to surveillance information management could be data corresponding to the means for processing raw surveillance information and transforming it into an integrated, comprehensive, and authoritative source for all consumers and service providers including the DC 140.

Navigation service data 136 corresponding to separation management could also be data representative of ANSP 130 constraints. Such constraints could be temporary in nature, such as the creation of a volume of airspace for the purpose of flight avoidance due to conditions such as weather, turbulence avoidance, and/or an increase in air traffic density. Another constraint could include a line defining the imposition of a plurality of metering fixes (i.e., a fixed point defined in terms of four dimensions).

Navigation service data 136 corresponding to flow contingency management could be data corresponding to the means through which demand is adjusted to meet system resource capacity constraints. Navigation service data 136 corresponding to short-term capacity management could be data corresponding to the means through which strategic planning is performed for applying available assets to adjust system capacity to meet the demand. Navigation service data 136 corresponding to long-term capacity management could be data corresponding to the means through which new system capacity is generated or developed.

In an embodiment of FIG. 1, the DC 140 could be comprised of one or more providers of dispatch services that could provide source data to the TC 150. Such source data could be comprised of current trajectory data 142, DC-selected trajectory data 144, and/or dispatch services data 146. A common example of the DC 140 is an airline operations center which employs flight dispatchers who may be responsible for planning and monitoring the progress of an aircraft in flight, where a flight dispatcher may have the authority to delay, divert, and/or cancel a flight at any time. Another example is the Rockwell Collins Ascend™ Flight Information Solutions which provides an owner and/or operator will tools, services, and support that may be needed for streamlined, efficient flight operations from pre-flight to post-flight and all operations in between.

In an embodiment of FIG. 1, the current trajectory data 142 may be comprised of data representative of the current trajectory that has been assigned to the aircraft. As embodied herein, the current trajectory represented in the current trajectory data 142 is the same current trajectory represented in the current trajectory data 112.

In an embodiment of FIG. 1, the DC-selected trajectory data 144 could be comprised of data representative of a proposed trajectory received from the TC 150, where the proposed trajectory could be indicative of a proposed change or modification to the current trajectory data 142. The DC 140 may request a proposed change and/or submit a DC-proposed trajectory automatically.

For an automatic initiation, the DC 140 could use a planned schedule based upon time and/or the position of the aircraft along the current trajectory. Also, the initiation could be based upon dispatch events such as changes in the aircraft parameter data that are known to the DC 140 and/or changes in the navigation service data 136 that are known to the DC 140. Also, changes arising from one or more of the following non-exhaustive list of dispatch events that are known to those skilled in the art: aircraft experiencing mechanical problem (s), missing passengers, changes to flight and/or crew schedules, changes of gate assignments at the arrival/departure terminal, and a shortage of terminal gates. In an embodiment of FIG. 1, dispatch service data 146 could be representative of one or more of the preceding dispatch events.

Similar to the ANSP 130, a proposed trajectory could be initiated manually by a dispatcher of the DC 140 through a manual input system, where such manual input system could be comprised of any source that provides or enables a controller to enter proposed trajectory information through a controller input device. The manual input system may include, but is not limited to, a tactile device and/or a speech recognition system.

In an embodiment of FIG. 1, the TC 150 could be configured with a TC generator 152, where the TC generator 152 may be configured to generate a plurality of TC-proposed trajectories through the use of one or more trajectory generating functions. Known to those skilled in the art, each of these functions may be designed to account for combinations of one or more aircraft parameters represented in the aircraft parameter data 116, one or more factors represented in the navigation service data 136, and/or one or more factors represented in the dispatch service data 146. Moreover, one or more of the trajectory functions could be the same function(s) employed by the ANSP 130 and/or the DC 140. As embodied herein, the TC 150 may be integrated with the aircraft system 110, the ANSP 130, or the DC 140.

In an embodiment of FIG. 1, the TC generator 152 may be any electronic data processing unit or combination of units which execute software or source code stored, permanently or temporarily, in a digital memory storage device as discussed above. The TC generator 152 may be driven by the execution of software or source code containing algorithms developed for the specific functions embodied herein. Common examples of electronic data processing units are microprocessors, Digital Signal Processors, Programmable Logic Devices, Programmable Gate Arrays, and signal generators; however, for the embodiments herein, the term generator is not limited to such processing units and its meaning is not intended to be construed narrowly. For instance, a processor could also consist of more than one electronic data processing units. As embodied herein, the TC generator 152 could be a processor(s) used by or in conjunction with any other system of the aircraft.

The TC generator 152 may be programmed or configured to exchange data with the aircraft system 110, the ANSP 130, and the DC 140. As embodied herein, the terms "programmed" and "configured" are synonymous with respect to the execution of software or source code developed for the specific functions and methods embodied herein. The TC generator 152 may be programmed to execute the methods embodied herein and discussed in detail below.

The advantages and benefits of the embodiments discussed herein may be illustrated by showing examples of exchanges of data that could occur between the aircraft system 110, the ANSP 130, the DC 140, and/or the TC 150 when a flight trajectory negotiation has been initiated and from which a trajectory is proposed and generated. This negotiation between the aircraft system 110, the ANSP 130, the DC 140, and/or the TC 150 may be made automatically and without knowledge of the pilot; however, prior to being established as a current trajectory, a proposed trajectory may require a pilot's acceptance. These are examples provided as a matter of illustration and not limitation of the embodiments disclosed herein.

Figure 3A:
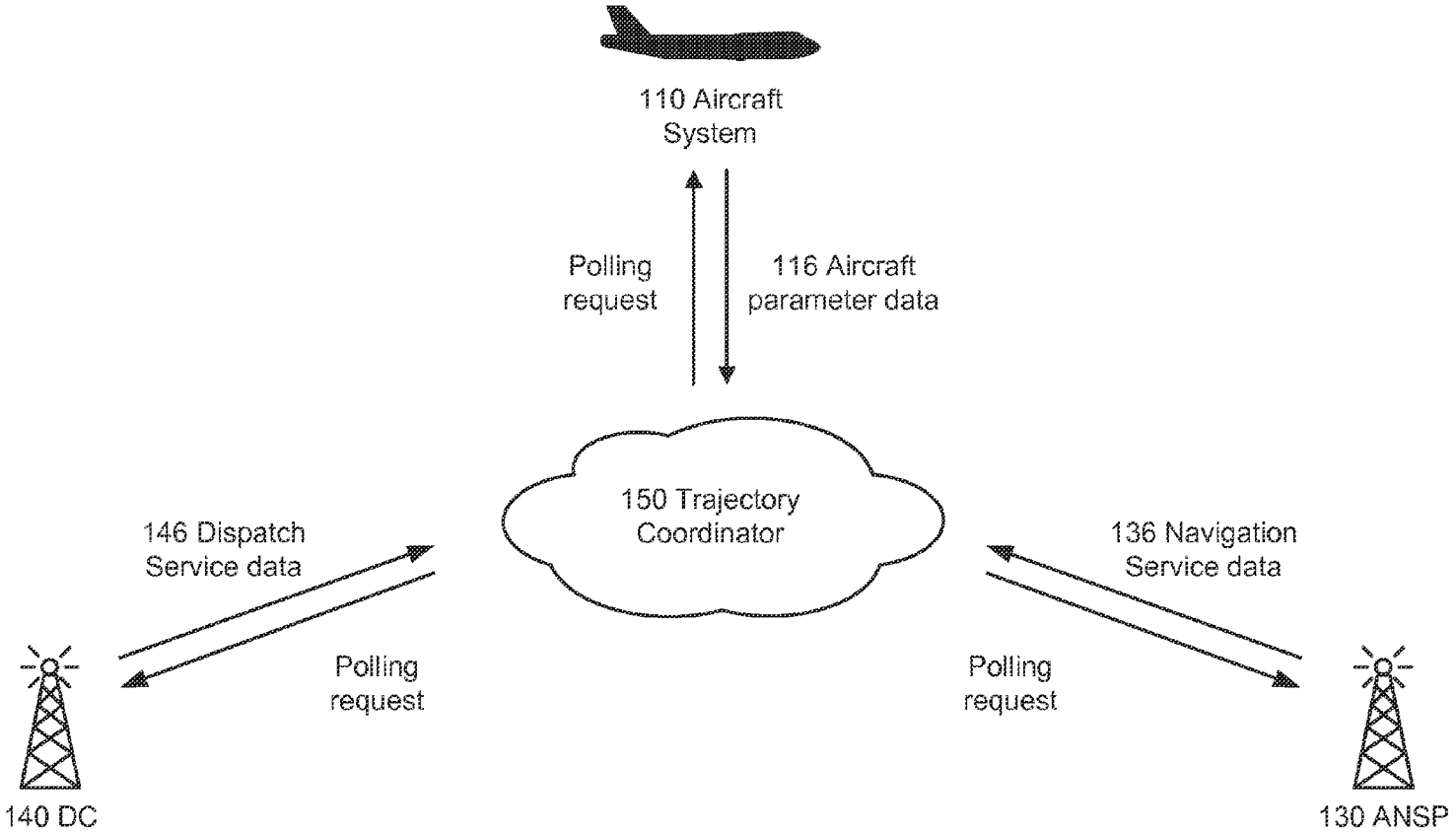
FIGS. 3A through 3B illustrate exchanges of data that could occur when a flight trajectory negotiation has been initiated by the TC.
Figure 3B:
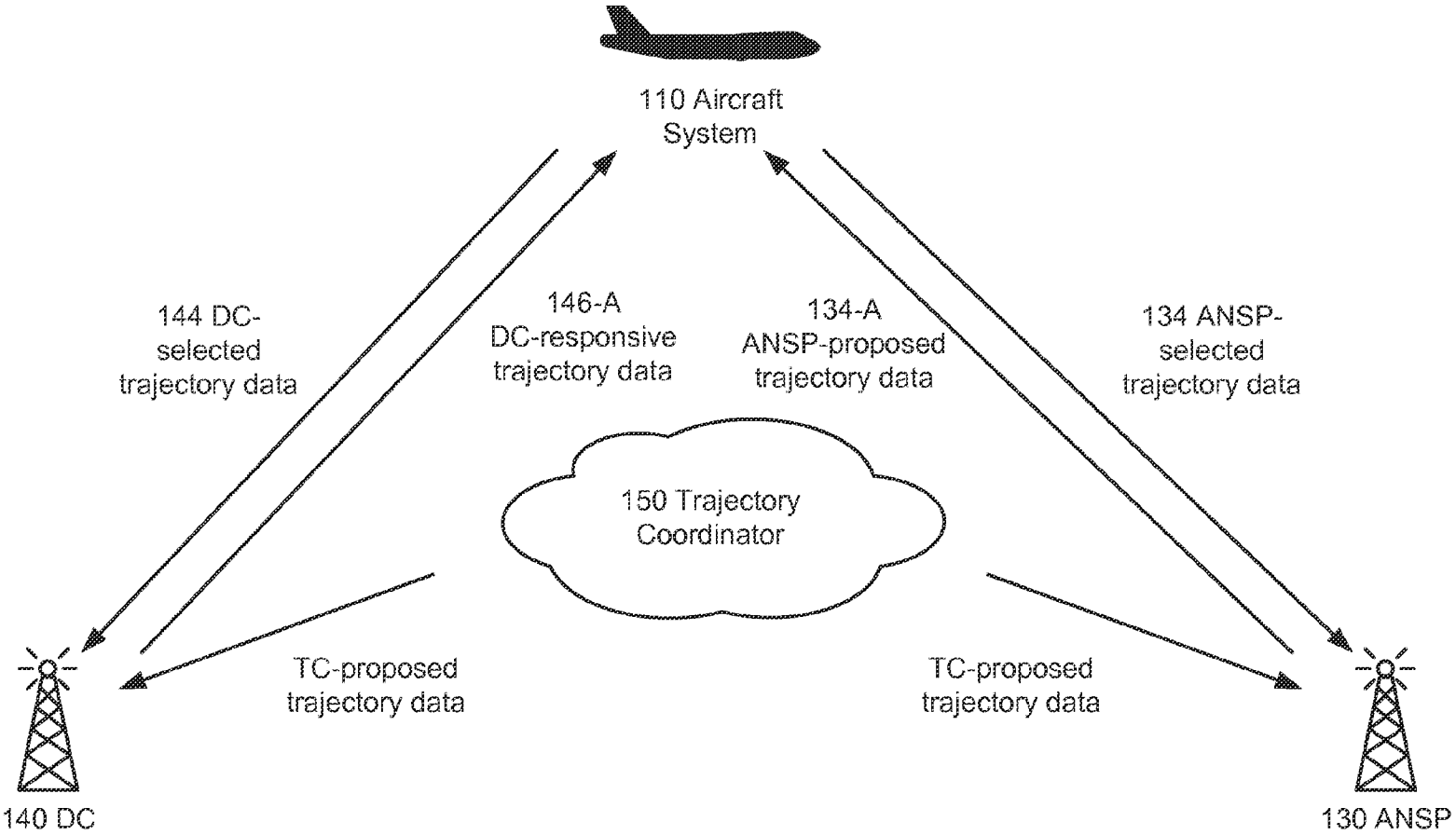
Figure 3C:
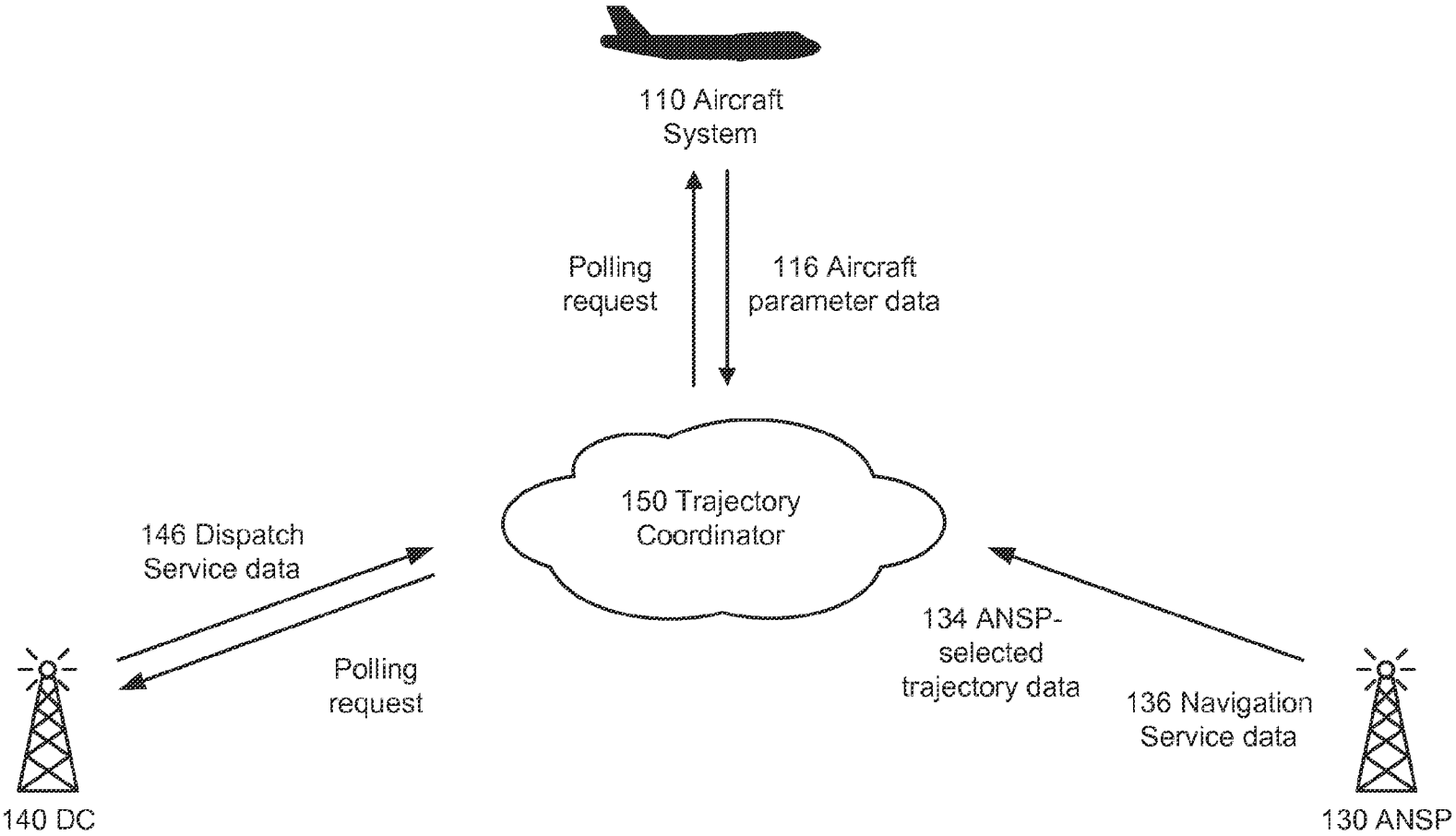
FIG. 3C illustrates an exchange of data that could occur when a flight trajectory negotiation has been initiated by the ANSP and/or the DC.

FIGS. 3A through 3C illustrate an exchange of data that could occur when a flight trajectory negotiation has been initiated by the TC 150. This initiation could be made automatically. Referring to FIG. 3A, when initiating the trajectory negotiation, the TC 150 may poll the aircraft system 110, the ANSP 130, and/or the DC 140 by sending a request to each for data. If current trajectory data is not maintained by the TC 150, the TC 150 may include in its poll a request for such current trajectory data to the aircraft system 110 of one or more aircraft, the ANSP 130, and/or the DC 140. In response to the polling request, the aircraft system 110 may send data representative of aircraft parameter 116 to the TC 150, the ANSP 130 may send navigation service data 136 to the TC 150, and the DC 140 may send dispatch data 146 to the TC 150. If requested, the current trajectory data may be provided in the response.

After the aircraft parameter data 116, the navigation service data 136, and the dispatch data 142 have been received, the TC 150 may generate one or more TC-proposed flight trajectories based upon the aircraft parameter data 116, the navigation service data 136, and the dispatch data 142. For example, if the received data is representative of inclement weather ahead of the aircraft, flight trajectories comprised of proposed waypoints located on each side of the weather could be generated. If a flight diversion to an alternative airport becomes apparent during flight, flight trajectories to alternative destinations could be generated.

Referring to FIG. 3B, TC-proposed trajectory data may be sent to the ANSP 130 and the DC 140. After receiving the TC-proposed flight trajectories, the ANSP 130 and the DC 140 may take subsequent action. A controller of the ANSP 130 and a dispatcher of the DC 140 may review and select one or more of them. Then, ANSP-selected trajectory data 134 and DC-selected trajectory data 144 representative of the selected trajectories may be sent to the aircraft system 110. In response, the selected trajectories may be presented to the pilot for his or her review and approval, and the data representative of the pilot-approved trajectory may be sent to the ANSP 130 and the DC 140.

In FIG. 3A, the TC 150 could have initiated the flight trajectory negotiation; however, the ANSP 130 and/or the DC 140 could have initiated the negotiations by sending the ANSP-proposed trajectory data and/or DC-proposed trajectory data to the TC 150, respectively. Referring to FIG. 3C and for the purpose of illustration only, the ANSP 130 has initiated the request by providing the TC 150 with ANSP-proposed trajectory data. Although not necessary, the ANSP 130 has also included the navigation service data 136. In response to receiving the request, the TC 150 may poll the aircraft system 110 and the DC 140 and receive aircraft parameter data 116 and DC-dispatch service data 146, respectively; if the navigation service data 136 was not included when the request was made, the TC 150 could also poll the ANSP 130 and receive such data.

After the aircraft parameter data 116, the navigation service data 136, and the dispatch data 142 have been received, the TC 150 may generate one or more TC-proposed flight trajectories based upon the aircraft parameter data 116, the navigation service data 136, and the dispatch data 142. Then, each TC-proposed trajectory could be compared against each ANSP-proposed trajectory. Based upon the results of the comparison(s), one or more of the ANSP-proposed trajectories may be sent to both the ANSP 130 and the DC 140 as TC-proposed trajectory data as shown in FIG. 3B.

Following the same discussion of FIG. 3B, the ANSP 130 and the DC 140 may take subsequent action after receiving the TC-proposed flight trajectories. A controller of the ANSP 130 and a dispatcher of the DC 140 may review and select one or more of them. Then, ANSP-selected trajectory data 134 and DC-selected trajectory data 144 representative of the selected trajectories may be sent to the aircraft system 110. In response, the selected trajectories may be presented to the pilot for his or her review and approval, and the data representative of the pilot-approved trajectory may be sent to the ANSP 130 and the DC 140.

Figure 4:
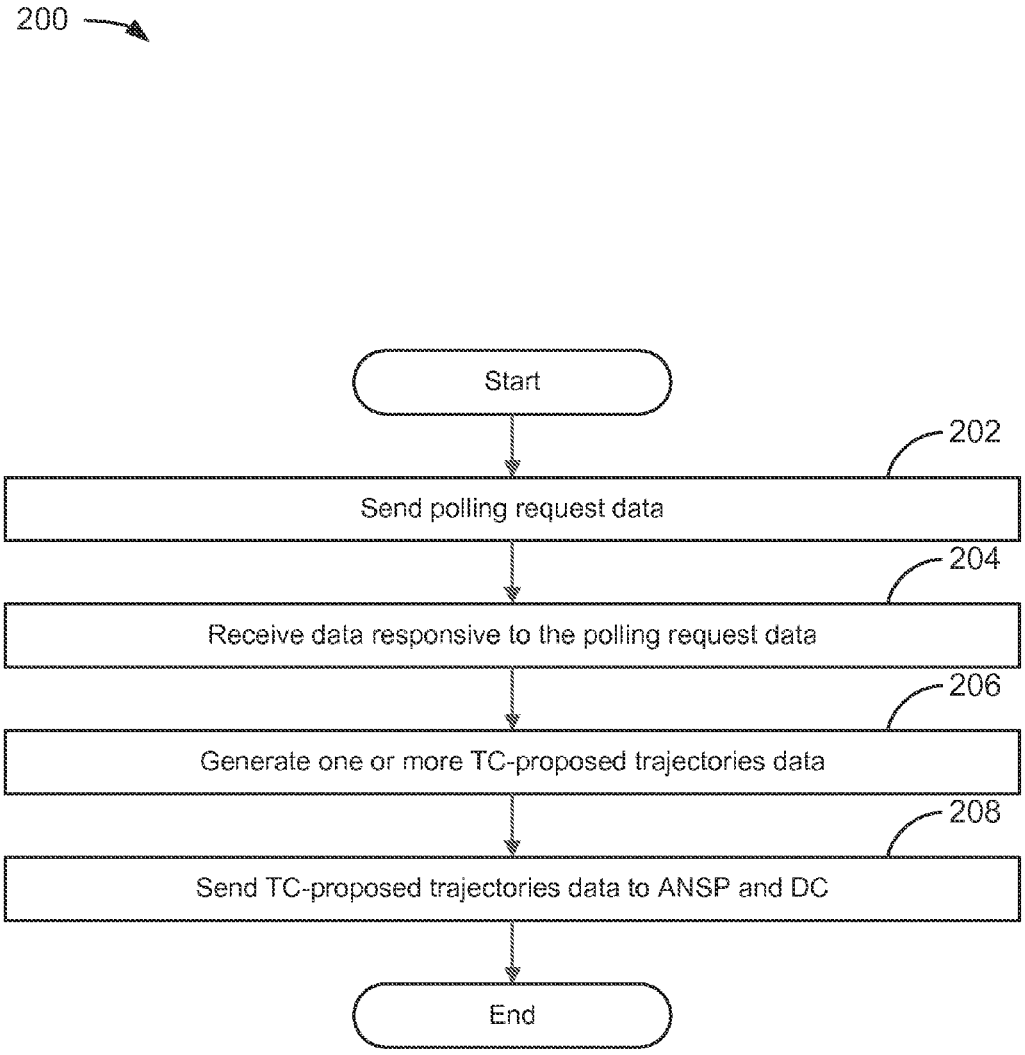
FIG. 4 depicts a first flowchart disclosing a communications method employed between the participants in a trajectory management operation

As embodied in FIG. 4, a flowchart 200 is depicted disclosing a communications method employed between the participants in a trajectory management operation, where the TC 150 may be configured with the TC generator 152 programmed with or configured to perform the instructions corresponding to the following modules of flowchart 200. As necessary for the accomplishment of the modules embodied in any of the flowcharts presented herein, the receiving of data is synonymous and/or interchangeable with the retrieving of data, and the sending of data is synonymous and/or interchangeable with the providing of data and/or making available or supplying of data.

The flowchart begins with module 202 with the sending of data representative of a polling request, where the polling request could be comprised of a request for aircraft parameter data 116. In an additional embodiment, data representative of an ANSP-proposed trajectory and/or DC-proposed trajectory could be received. If this received data does not include navigation service data 136 and/or dispatch service data 146, respectively, then the polling request could be further comprised of navigation service data 136 and/or dispatch service data 146.

The flowchart continues with module 204 with the receiving of data responsive to the sending of data in module 202. The flowchart continues with module 206 with the generating of data representative of one or more TC-proposed trajectories. In one embodiment, each TC-proposed trajectory could have been generated by the TC 150 as a function of the aircraft parameter data 116, the navigation service data 136, and/or the dispatch service data 146. In an embodiment in which data representative of an ANSP-proposed trajectory and/or DC-proposed trajectory has been received, each TC-proposed trajectory could be compared against each ANSP-proposed trajectory and/or each DC-proposed trajectory. Based upon the results of the comparison(s), one or more of the ANSP-proposed trajectories and/or the DC-proposed trajectories may be included as TC-proposed trajectory data by the TC 150.

The flowchart continues with module 208 with the sending of data representative of one or more TC-proposed trajectories to the ANSP 130 and/or the DC 140, whereby a controller in the ANSP 130 and/or a dispatcher of the DC 140 may make a selection of one or more of them. Then, the flowchart proceeds to the end.

Figure 5:
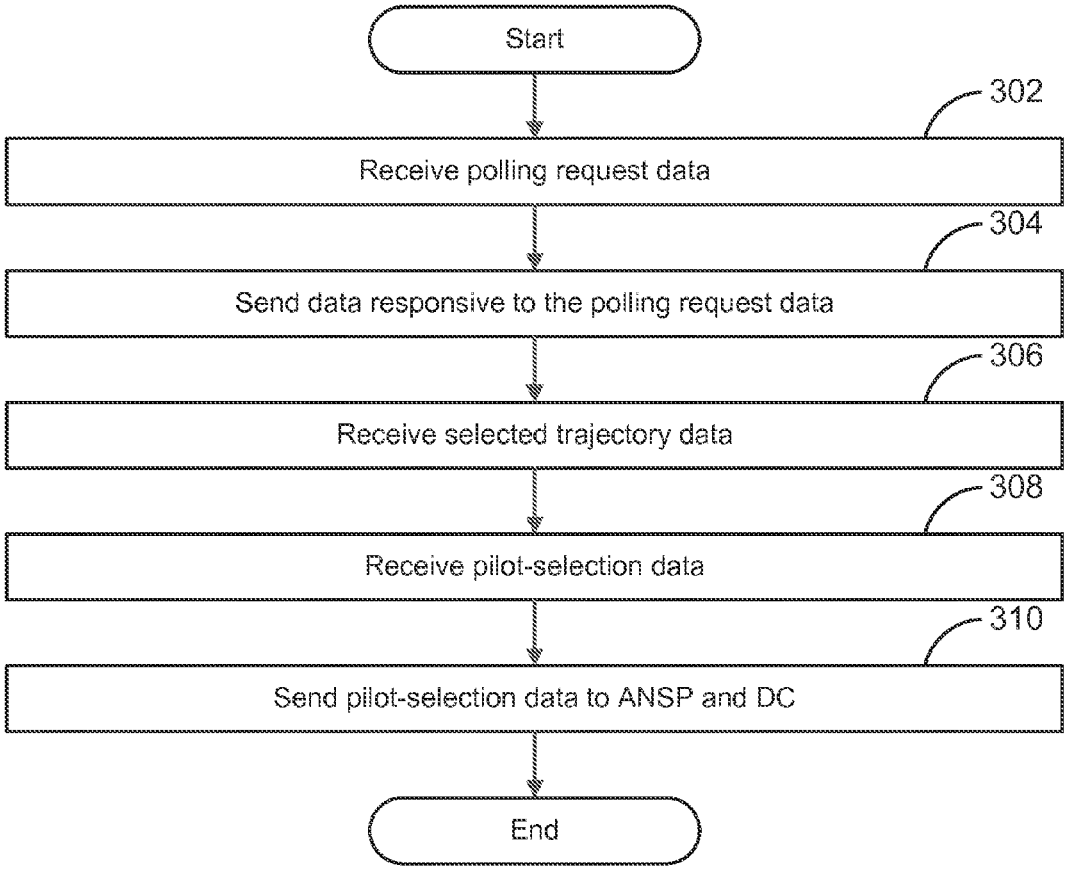
FIG. 5 depicts a second flowchart disclosing a communications method employed between the participants in a trajectory management operation.

As embodied in FIG. 5, a flowchart 300 is depicted disclosing a communications method employed between the participants in a trajectory management operation, where the aircraft system 110 may be configured with a processor or processing unit programmed with or configured to perform the instructions corresponding to the following modules of flowchart 300.

The flowchart begins with module 302 with the receiving of data representative of a polling request for aircraft parameter data sent by the TC 150. The flowchart continues with module 304 with the sending of data representative of aircraft parameter data 116 in response to the request, where the aircraft parameter data could have been provided by an aircraft parameter data source. As embodied herein, the aircraft parameter data source could be the aircraft system 110. Additionally, the aircraft parameter data source could be the aircraft system 110 of a plurality of aircraft.

The flowchart continues with module 306 with the receiving of data representative of one or more ANSP-selected trajectories, one or more DC-selected trajectories, or both. As embodied herein, one or more of these selected trajectories could be comprised of one or more TC-proposed trajectories, where each TC-proposed trajectory could have been generated as a function of at least the aircraft parameter data.

The flowchart continues with module 308 with the receiving of data representative of a pilot's selection of a trajectory responsive to being presented with one or more of the ANSP-selected trajectories and/or DC-selected trajectories. The flowchart continues with module 310 with the sending of the data representative of the pilot's selection of a trajectory to the ANSP 130 and/or the DC 140. Upon receipt, the ANSP 130 and/or the DC 140 may update the current trajectory with the proposed trajectory if the pilot's selection corresponds to an acceptance of a trajectory. Then, the flowchart proceeds to the end.

Figure 6:
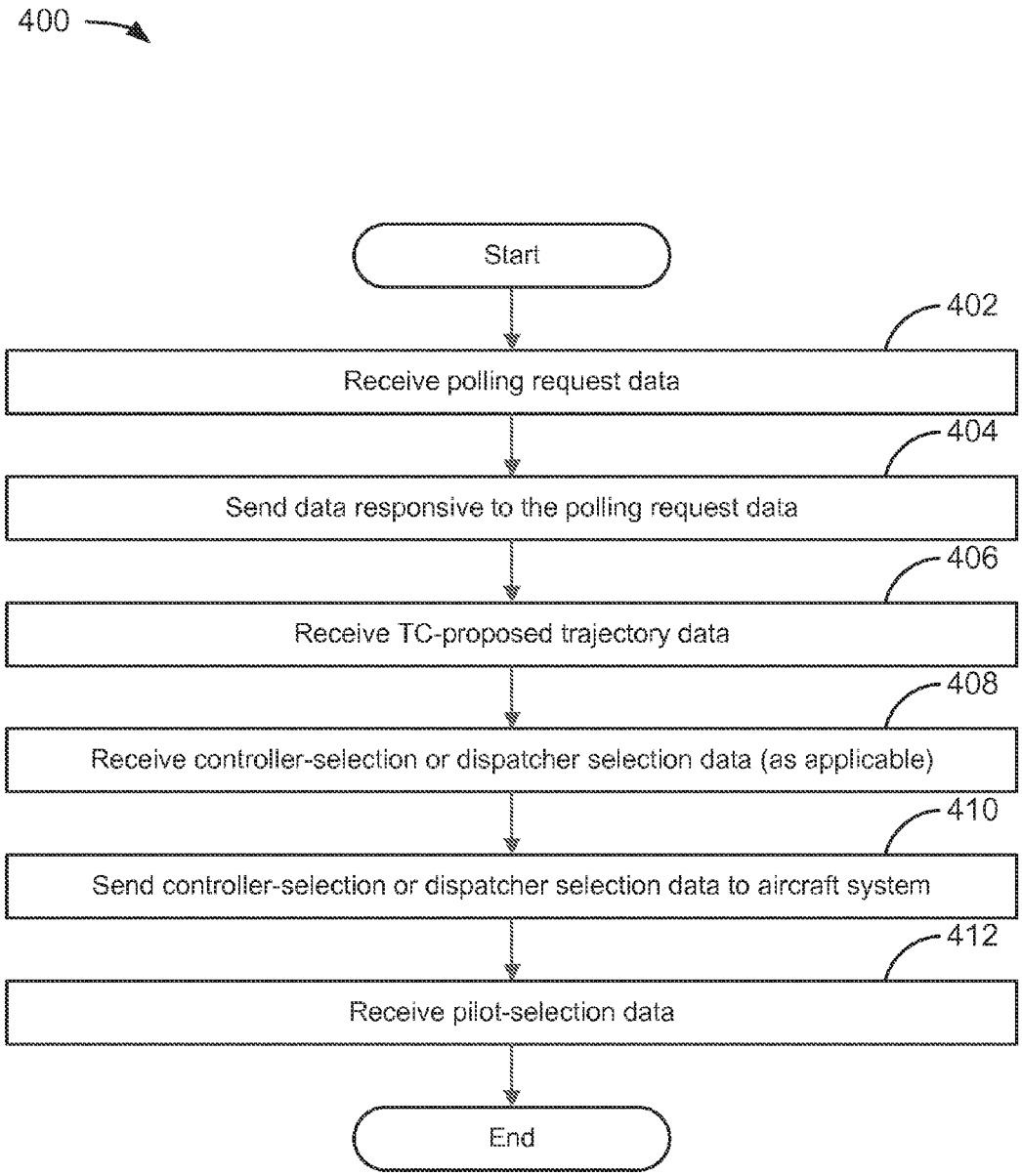
FIG. 6 depicts a third flowchart disclosing a communications method employed between the participants in a trajectory management operation.

As embodied in FIG. 6, a flowchart 400 is depicted disclosing a communications method employed between the participants in a trajectory management operation, where the ANSP 130 or the DC 140 may be configured with a processor or processing unit programmed with or configured to perform the instructions corresponding to the following modules of flowchart 400.

The flowchart begins with module 402 with the receiving of data sent by the TC 150, where the data may be representative of a polling request for navigation service data 136 if received by the ANSP 130 or dispatch service data 146 if received by the DC 140. The flowchart continues with module 404 with the sending of data representative of navigation service data 136 or the dispatch service data 146, as applicable.

The flowchart continues with module 406 with the receiving of data representative of one or more TC proposed trajectories, where each TC-proposed trajectory could have been generated as a function of the navigation service data 136 or the dispatch service data 146, as applicable.

The flowchart continues with module 408 with the receiving of data representative of a controller's selection or a dispatcher's selection, as applicable, responsive to being presented with one or more of the TC-proposed trajectories. The flowchart continues with module 410 with the sending of data representative of one or more ANSP-selected trajectories or DC-selected trajectories, as applicable, to the aircraft system 110.

The flowchart continues with module 412 with the receiving of data representative of a pilot's selection of a trajectory responsive to being presented with one or more of the ANSP-selected trajectories and/or DC-selected trajectories. Upon receipt, the ANSP 130 and/or the DC 140 may update the current trajectory with the proposed trajectory if the pilot's selection corresponds to an acceptance of a trajectory. Then, the flowchart proceeds to the end.

It should be noted that the method steps described above may be embodied in computer-readable media as computer instruction code. It shall be appreciated to those skilled in the art that not all method steps described must be performed, nor must they be performed in the order stated.

As used herein, the term "embodiment" means an embodiment that serves to illustrate by way of example but not limitation.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such permutations, enhancements, equivalents, and improvements thereto that fall within the true spirit and scope of the present invention.

What is claimed is:

1. A communication method employed between the participants in a trajectory management operation comprised of a trajectory coordinator ("TC"), an air navigation service provider ("ANSP"), and a dispatch center ("DC"), such method performed by a TC installed in an aircraft and comprised of:

sending data representative of a polling request to at least one aircraft system, where the polling request is comprised of a request for aircraft parameter data other than current trajectory data, where the aircraft parameter data is representative of at least actual aircraft configuration and system parameters;

receiving aircraft parameter data other than current trajectory data from each aircraft system that is responsive to the sending of data representative of the polling request;

generating data representative of at least one TC-proposed trajectory as a function of at least the aircraft parameter data; and sending data representative of said at least one TC-proposed trajectory to an ANSP, a DC, or both, whereby a controller is presented with at least one TC-proposed trajectory when sent to the ANSP, and a dispatcher is presented with at least one TC-proposed trajectory when sent to the DC.

2. The communication method of claim 1, further comprising:

receiving data representative of an ANSP-proposed trajectory, where the sending of the data representative of a polling request was made in response to receiving the data representative of an ANSP-proposed trajectory.

3. The communication method of claim 2, wherein at least one ANSP-proposed trajectory is included as a TC-proposed trajectory sent to the ANSP, the DC, or both.

4. The communication method of claim 2, wherein the polling request is further comprised of a request for dispatch service data.

5. The communication method of claim 4, wherein the polling request is further comprised of a request for navigation service data if the navigation service data is not received with the data representative of an ANSP-proposed trajectory.

6. The communication method of claim 1, further comprising:

receiving data representative of an DC-proposed trajectory, where the sending of the data representative of a polling request was made in response to receiving the data representative of an DC-proposed trajectory.

7. The communication method of claim 6, wherein at least one DC-proposed trajectory is included as a TC-proposed trajectory sent to the ANSP, the DC, or both.

8. The communication method of claim 6, wherein the polling request is further comprised of a request for navigation service data.

9. The communication method of claim 8, wherein the polling request is further comprised of a request for dispatch service data if dispatch service data is not received with the data representative of a DC-proposed trajectory.

10. A communication method employed between the participants in a trajectory management operation comprised of a trajectory coordinator ("TC"), an air navigation service provider ("ANSP"), and a dispatch center ("DC"), such method performed by a TC installed in an aircraft and comprised of:

receiving data representative of a polling request sent to at least one aircraft, where the polling request is comprised of a request for aircraft parameter data other than current trajectory data, where the aircraft parameter data is representative of at least actual aircraft configuration and system parameters;

sending first data comprised of data representative of at least one TC-proposed trajectory and second data comprised of aircraft parameter data other than current trajectory data that are responsive to the receiving of data representative of a polling request for aircraft parameter data, such that the at least one TC-proposed trajectory is generated as a function of at least the aircraft parameter data other than current trajectory data;

receiving data representative of at least one ANSP-selected trajectory, at least one DC-selected trajectory, or at least one ANSP-selected trajectory and at least one DC-selected trajectory;

receiving data representative of a pilot-selected trajectory; and sending data representative of the pilot-selected trajectory to the ANSP and the DC.

11. The communication method of claim 10, wherein at least one ANSP-selected trajectory is comprised of a TC-proposed trajectory.

12. The communication method of claim 10, wherein at least one DC-selected trajectory is comprised of a TC-proposed trajectory.

13. The communication method of claim 10, wherein the pilot-selected trajectory is comprised of trajectory corresponding to a pilot's selection of one ANSP-selected trajectory or one DC-selected trajectory.

14. The communication method of claim 10, wherein the at least one ANSP-selected trajectory is selected from the at least one TC-proposed trajectory.

15. The communication method of claim 10, wherein the at least one DC-selected trajectory is selected from the at least one TC-proposed trajectory.

16. A communication method employed between the participants in a trajectory management operation comprised of a dispatch center ("DC") and a trajectory coordinator ("TC"), such method performed by a processor or processing unit operated by a DC and comprised of:

receiving data representative of a polling request, where the polling request is comprised of a request for dispatch service data;

sending data representative of the dispatch service data that is responsive to the receiving of data representative of a polling request;

receiving data representative of at least one TC-proposed trajectory, wherein the at least one TC-proposed trajectory is generated by a TC as a function of the dispatch service data and aircraft parameter data other than current trajectory data, where the aircraft parameter data is provided by at least one aircraft system in response to receiving of a polling request for aircraft parameter data from the TC, and is representative of at least actual aircraft configuration and system parameters;

generating data representative of at least one DC-selected trajectory, wherein the at least one DC-selected trajectory is selected from the at least one TC-proposed trajectory;

sending data representative of the at least one DC-selected trajectory to at least one aircraft system; and receiving data representative of a pilot-selected trajectory selected from the at least one DC-selected trajectory.

17. The communication method of claim 16, wherein the TC is integrated with the DC.

18. The communication method of claim 16, wherein the TC is integrated with the at least one aircraft system.

19. The communication method of claim 16, wherein the TC is integrated with an air navigation service provider.

* * * * *